US005109682A

United States Patent [19]

Toschi et al.

[11] Patent Number: 5,109,682

[45] Date of Patent: May 5, 1992

[54] APPARATUS FOR THE PREPARATION AND DISTRIBUTION OF DYE SOLUTIONS IN DYEING PLANTS

[75] Inventors: Fabrizio Toschi, Breganze; Massimo Meneghini, Vicenza, both of Italy

[73] Assignee: Color Service SRL, Vincentina, Italy

[21] Appl. No.: 564,193

[22] Filed: Aug. 8, 1990

[30] Foreign Application Priority Data

Aug. 29, 1989 [IT] Italy ..... 85639 A/89

[51] Int. Cl.[5] ..... D06B 23/14

[52] U.S. Cl. ..... 68/13 R; 68/205 R; 366/51; 366/20; 137/3

[58] Field of Search ..... 366/8, 51, 20, 162, 366/249, 190; 137/874, 625.11, 240, 597, 3; 68/12 R, 13 R, 205 R

[56] References Cited

U.S. PATENT DOCUMENTS

| | | | |
|---|---|---|---|
| 1,528,698 | 3/1925 | Sandeman et al. | 68/205 R |
| 3,240,225 | 3/1966 | Barrows | 137/240 |
| 3,443,578 | 5/1969 | Hedin | 137/240 |
| 3,468,322 | 9/1969 | Katzer | 137/3 X |
| 3,674,205 | 7/1972 | Kock | 137/240 |
| 3,969,780 | 7/1976 | Henderson | 68/205 R |
| 3,987,808 | 10/1976 | Carbonell et al. | 137/3 |
| 4,005,590 | 2/1977 | McLean | 68/205 R |
| 4,252,139 | 2/1981 | Davis et al. | 137/3 |
| 4,485,840 | 12/1984 | Erwin | 137/240 |
| 4,632,149 | 12/1986 | Oroskar et al. | 137/625.11 |

FOREIGN PATENT DOCUMENTS

| | | | |
|---|---|---|---|
| 0046667 | 3/1982 | European Pat. Off. . | |
| 0277365 | 1/1987 | European Pat. Off. . | |
| 0299522 | 1/1989 | European Pat. Off. . | |
| 3151511 | 7/1983 | Fed. Rep. of Germany . | |
| 829458 | 3/1960 | United Kingdom | 137/3 |

*Primary Examiner*—Frankie L. Stinson

[57] ABSTRACT

The invention discloses an apparatus for the preparation and distribution of dye solutions to a dyeing apparatus or to a color kitchen, including a unit for the loading of powder-dye into dissolution vats, a collector unit for conveyance of the dye solution to a distributor unit and for pipe flushing, and a distributor unit. The collector unit consists of a selection-plate, which alternatively connects the distributor unit with the dissolution vats or with a flushing water-network, wherein the distributor unit consists of a plurality of outlets supplied by the collector unit, through a rotary collector, the outlets being connected with the dyeing equipment or with the color kitchen, or with sewers.

8 Claims, 3 Drawing Sheets

APPARATUS FOR THE PREPARATION AND DISTRIBUTION OF DYE SOLUTIONS IN DYEING PLANTS

BACKGROUND OF THE INVENTION

1. Field of the Invention

The invention concerns an apparatus which is particularly suited to the preparation and distribution of dye solutions to dyeing equipment or to the colour kitchen in dyeing plants.

2. Description of Related Art

It is a known fact that in dyeing plants the preparation of the dye solution is obtained by dissolving the compounded formula in special vats, by blending together a plurality of dyes in powder form.

After the solution has been prepared by using water or other solvents, it is poured into the dye apparatus, or it is sent to the color kitchen.

The loading of the formula of the powder dyes in the vats and the distribution of the obtained solution to the dyeing equipment or to the color kitchen, can be carried out manually or by automatic systems.

Apparatuses are known in which a series of pipes departing from the vat conduct the prepared solution to the dyeing equipment or to the color kitchen. In these pipes the flows are controlled by operating three-way valves.

Sometimes the use of such three-way valves causes inconveniences in the performance of the apparatuses.

The first inconvenience arises when one of the valves clogs up, i.e. it does not open when required or it remains blocked in its open position and the material being dyed can undergo serious damage. In fact the material will not be dyed in conformity with the request and will, therefore, be irreparably ruined.

Another inconvenience is that the three-way valves are rarely perfectly washed when the pipes are rinsed, and therefore there is always the risk that a small quantity of the dye remains in the valves even after the rinsing, and that it may negatively effect the dyes that follow.

Another important inconvenience is that the plastic parts of the three-way valves are damaged because the dye powders are dissolved in very hot water.

Moreover the three-way valves are very expensive and this factor affects the total cost of the apparatus for the distribution of the dye solution.

SUMMARY OF THE INVENTION

The purpose of the present invention is to eliminate the above-described inconveniences through the realization of an apparatus particularly suited to the preparation and the distribution of dye solutions to the dyeing equipment or to the color kitchen in dyeing plants, which comprises:

- a unit for the loading of dye powders in the dissolution vats; characterized in that it includes:
- a collector unit for the collecting of the prepared dye solution flowing out of the dissolution vats, for the conveyance of said solution to the distribution unit and for the cleaning of the pipes conceying the dye solution;
- a distribution unit for the conveyance of the dye solution to the dyeing equipment or to the colour kitchen.

According to a preferred embodiment of the invention, the collector unit consists of a selection plate confronting an inlet which can be connected alternatively, through movable collecting pipes 136, 148, with a pipe conveying the dye solution from any one of a plurality of dissolution vats, or with the waterworks, since the inlet is firmly connected at the outlet with the inlet of the distributor unit by means of pipes.

According to a preferred embodiment of the invention, the distributor unit presents a variety of outlets which are circumferentially distributed around a plate of which at least one outlet is connected to the sewage pipes, while each of the others is connected with a pipe feeding the dyeing equipment or the color kitchen, where this distributor unit presents a rotary distributor which allows the connection between the inlet and any selected outlet.

Advantageously, according to the invention, an apparatus is created from which the three-way valves are eliminated and consequently the risk of mistakes occurring in the dyeing process, due to a defective performance or to the blocking of any one of the valves, is prevented, as well as the risk of possible contamination due to insufficient rinsing of the valves themselves.

Moreover, the elimination of each three-way valve brings a notable reduction of the cost of the solution distributing apparatus. The apparatus of the invention allows for a nearly total automation of the process, and in fact can function under the simple supervision of a single, not particularly specialized employee, since it can be controlled by a computer.

Further scope of applicability of the present invention will become apparent from the detailed description given hereinafter.

BRIEF DESCRIPTION OF THE DRAWINGS

However, it should be understood that the detailed description and specific example, while indicating a preferred embodiment of the invention, are given by way of illustration only, since various changes and modifications within the spirit and scope of the invention will become apparent to those skilled in the art from this detailed description and the drawings, wherein.

DETAILED DESCRIPTION OF PREFERRED EMBODIMENTS

Figure 1:
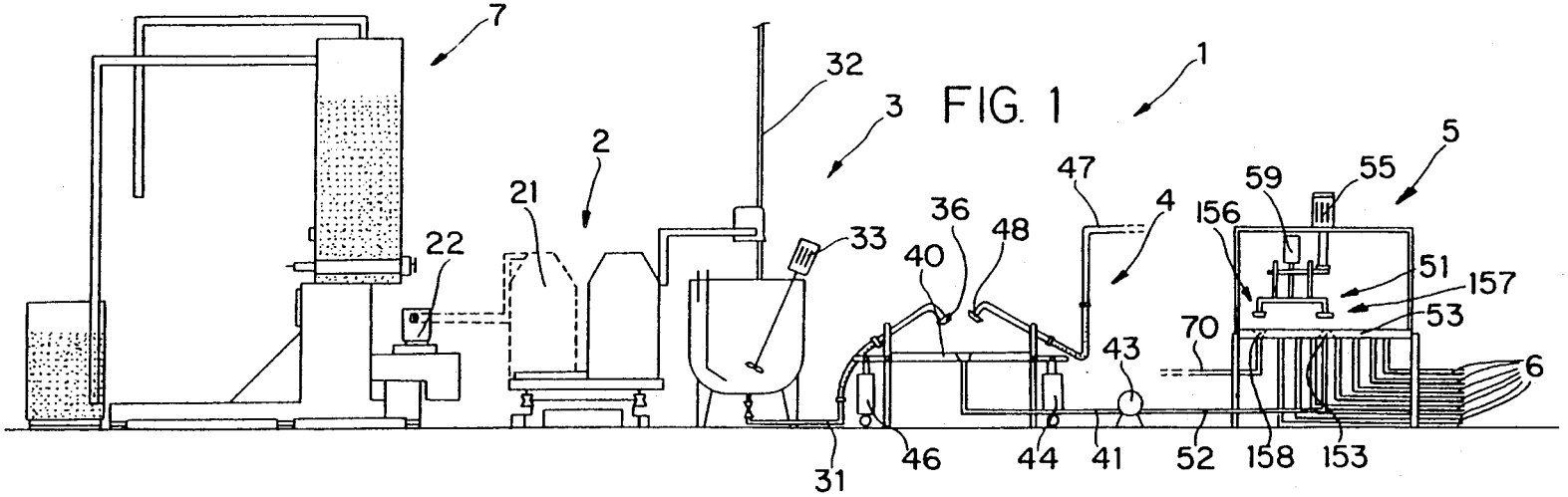
FIG. 1 shows the apparatus of the invention with the distribution system unconnected.

As can be observed in FIG. 1, the apparatus of the invention, indicated as a whole with 1, consists of a unit 2 for the loading of the dye powders in dissolution vat 3, from a bottom of which departs a pipe 31, that goes towards a collector unit 4, from which, in turn, departs another pipe 41, which conveys the dye solution through a circulation pump 43 and a pipe 52 to a distributor unit 5. The distributor unit 5 conveys, through a rotary distributor 51 and pipes 6, the solution either to the dyeing equipment or to the color kitchen, both not represented in the drawing.

The apparatus of the invention can be usefully completed by installing upstream an automatic weighing system 7 for the preparation of the formula by mixing the necessary dye powders, which was the object of the patent application No. 85535/A/87 by the same inventor of the present invention. It is understood that the system of preparation 7 has been introduced in the drawing and is quoted in the description of the system of the invention by way of illustration only, since the preparation of the formula can be obtained in any manner, even manually.

The loading unit 2 has a robot 21, which picks up a container 22, containing the formula, and pours the dye powders contained therein into the dissolution vat 3.

Even in this case it has to be observed that instead of a single robot 21, more robots can be used when there are several containers 22 to be handled.

Moreover the loading unit 2 instead of consisting of robots 21 could consist of simple manipulators or of other automatic or manual mechanical devices. When the dye powders, constituting the formula, are inside the dissolution vat 3, some water is let into the same dissolution vat 3 through the pipe 32, and a dissolution process is carried out by means of a mixing device 33, obtaining the dye solution.

When the dye powder is completely dissolved, the dye solution can be conveyed to the dyeing equipment or to the color kitchen. To this purpose, as it can be observed in FIG. 2, the collector unit 4 is arranged so that its pipe 41 conveys to the distributor unit 5 the dye solution it receives through the pipe 31, and which flows out through the bottom of the dissolution vat 3.

To this purpose an inlet 45 of a selection plate 40 is connected with a pipe union 36 at the end of a collector pipe 136, connected with the pipe 31, which conveys the dye solution.

Figure 2:
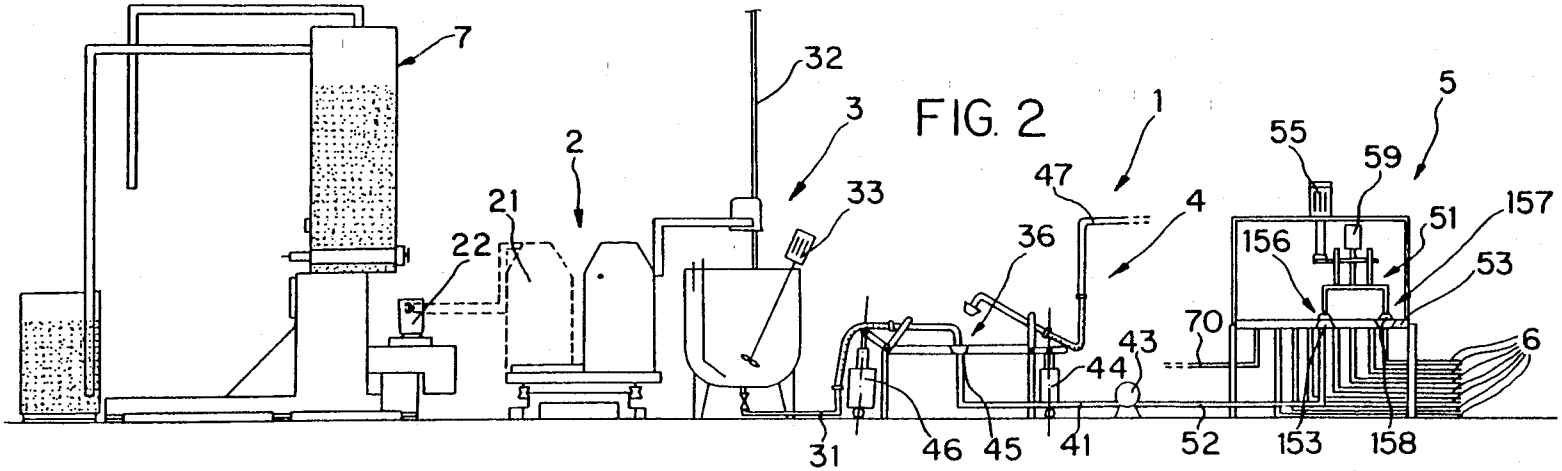
FIG. 2 represents the same apparatus of FIG. 1 in the phase while the pipes are being filled for the distribution to the dyeing equipment or to the color kitchen.

In order to convey the dye solution, a jack 46 is activated and through a square 146, having its fulcrum at the spot marked with 246 of plate 40 and supporting the collector pipe 136, the collector pipe 136 is caused to rotate and to penetrate through its pipe union 36 into inlet 45 and, therefore, acquire the position represented in FIG. 2.

To allow rotation around the fulcrum 246, the collector 136 and the pipe 31 are connected to each another through a flexible pipe 236.

At the same time the distributor unit 5 is arranged so as to activate the rotary distributor 51 which will connect pipe 52 for the conveyance of the dye solution into communication with any one of the pipes 6 conveying the solution either to the dye equipment or to the color kitchen.

In order to achieve this, it is necessary primarily to start a step motor 55 which will cause the distributor 51 to rotate as much as necessary for it to arrange itself on the vertical line of the outlet of the chosen delivery pipe 6.

Figure 6:
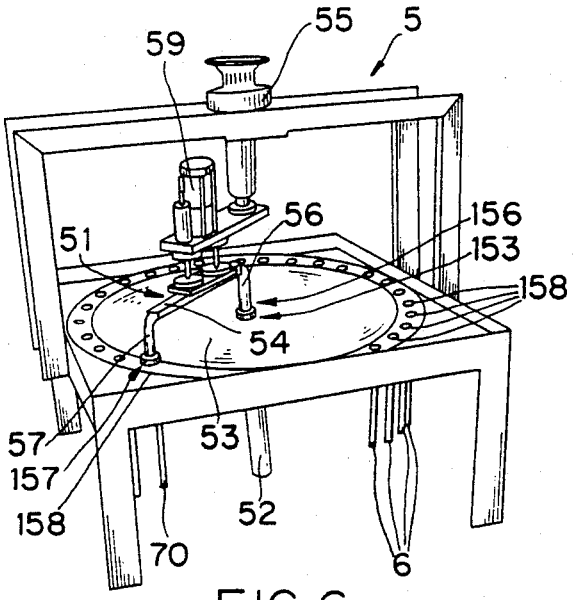
FIG. 6 represents the distributor unit of the apparatus of the invention in an axonometric view.

To explain this clearly, FIG. 6 shows an axonometric view of the distributor unit 5, and it can be observed that the rotary distributor 51, supporting a type "U" collector pipe 54, has its central end 56 connected with an inlet 153 of the pipe 52, coming from the pump 43, while the periferal end 57 is alternatively connected with one selected outlet 158 of the distributor plate 53, each being connected with one of the pipes 6 for the conveyance of the dye solution to the dyeing equipment or to the colors kitchen.

When the end 57 of the type "U" collector pipe 54 is positioned on the vertical line of the selected outlet 158, (the end 56 of said collector is always positioned on the vertical line of inlet 153) the rotary distributor 51 and therefore the collector pipe 54 are vertically lowered, through the action of jack 59, thereby inserting the pipe union 157 of the periferal end 57 into the selected outlet 158 and the pipe union 156 of the central end 56 in the inlet 153.

Figure 7:
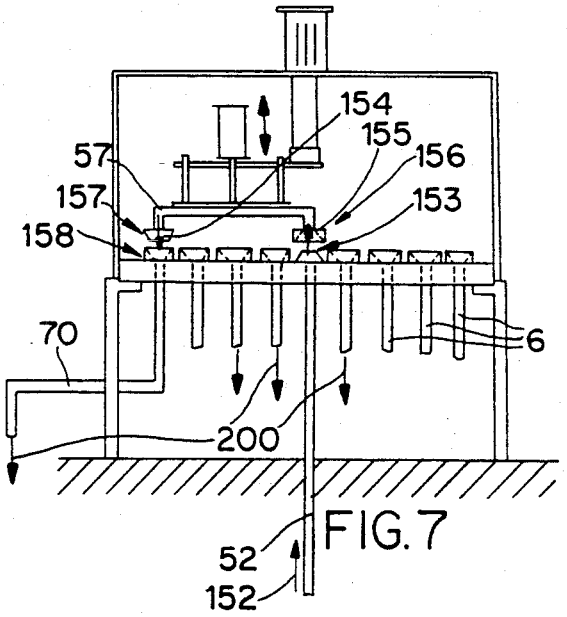
FIG. 7 represents a vertical section of the distributor unit of FIG. 6 seen from the front.

The seal at the junction points between the pipe unions 157 and 156 of the ends of the type "U" collector pipe 54 and the inlets 153 and the outlets 158 which are on the plate of distribution 53, as can be observed in FIG. 7, is obtained through tapered couplings.

Figure 8:
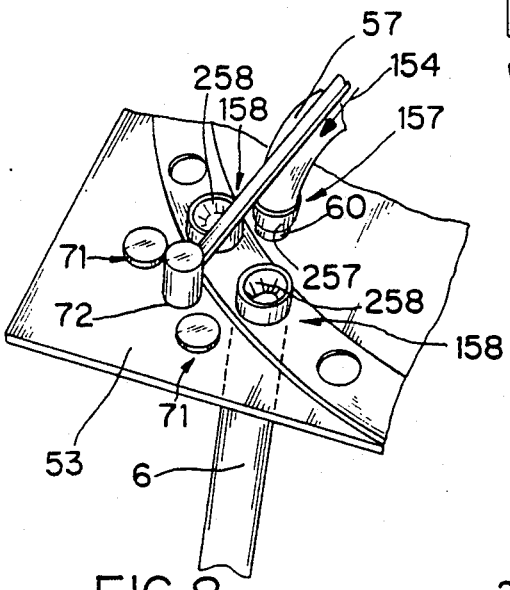
FIG. 8 represents the detail of the point of connection of the rotary distributor with the outlets of the distributor unit of FIG. 6.

In particular, as can be observed in FIG. 8, each outlet 158 presents a female tapered edge 258 within which is inserted the pipe union 157, constituting the peripheral end 57 of the type "U" collector pipe 54, which presents, on the contrary, a male tapered edge 257, so that the seal between the surfaces 258 and 257, when in contact, is guaranteed by the presence of a washer 60 or by equivalent means.

Figure 9:
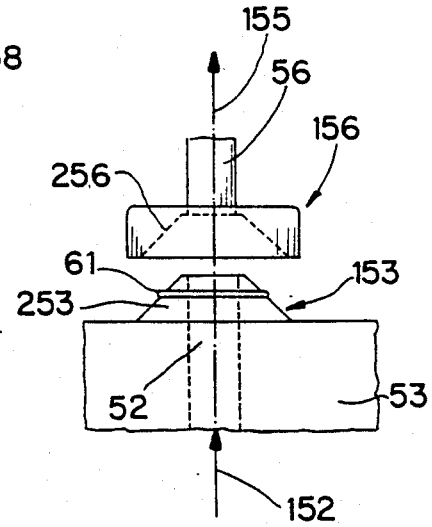
FIG. 9 shows the detail of the point of connection of the rotary distributor with the central inlet of the distributor unit of FIG. 6.

As far as the junction between the central end 56 of the type "U" collector pipe 54 and the central inlet 153, belonging to the distributor plate 53, is concerned, FIG. 7 and in particular FIG. 9 shown that the inlet 153, belonging to the distributor plate 53, presents a male tapered edge 253, while the pipe union 156 of the central end 56 of the type "U" collector pipe 54, presents a female tapered edge 256, so that the seal between the surfaces 253 and 256, when in mutual contact, is guaranteed by a washer 61.

It is interesting to observe, with reference to the FIGS. 7, 8 and 9, that the various shapes of the pipe unions 156 and 157 of the ends 56 and 57 of the type "U" collector pipe 54 are created in order to favor the flow of the dye solution through the passage in the junctions.

This is the reason why at the junctions, the end having a male edge is always the end of the pipe from which the dye solution flows out, while the end with the female tapered edge is always the end of the pipe into which the solution flows.

This is the reason why, as can be observed in said figures, the tapers of the outlet 158 and of the pipe union 156 of the central end 56 of the collector pipe 54 are tapered female, since they receive the flows entering in direction 200 and 155 respectively, while the tapers of the inlets 153 and of the pipe union 157 of the peripheral end 57 of the collector pipe 54 are tapered male, since they receive the flow going out in with directions 152 and 154 respectively.

Figure 4:
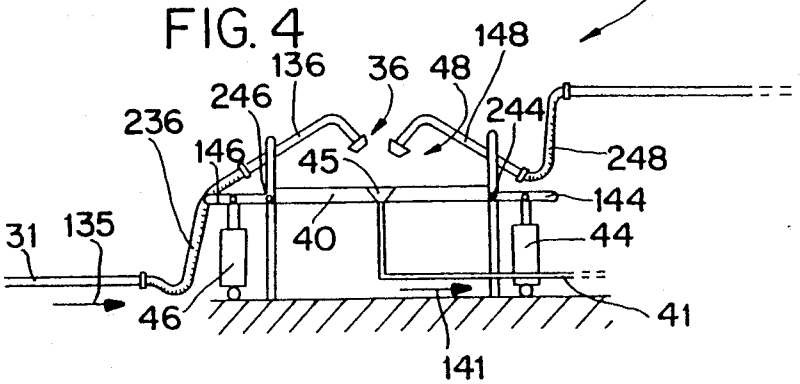
FIG. 4 shows the detail of the collector unit of the apparatus of the invention.

Therefore, the description given for the distributor unit 5, applies also for the collector unit 4, as shown in FIG. 4, wherein the pipe unions 36 and 48 and the inlet 45 of the selection plate 40 present taper-shaped ends.

In particular, the pipe unions 36 and 48 belonging respectively to the pipes 136 and 148 have a male tapered edge which engages with a corresponding female tapered edge of the inlet 45 of the selection plate 40.

It can be observed that in this case the direction of the conicity of the pipe unions 36 and 48 and of the inlet 45 is in accordance with the directions of the flow which are indicated by the arrows 135, 147 and 141 of the pipes 136, 148 and 41 respectively.

When both the collector unit 4 and the distributor unit 5 are arranged as represented in FIG. 2, the pump 43 is activated and the dye solution is transferred from the dissolution vat 3 to any pipe 6, which has previously been selected, and from there it is conveyed either into a dyeing apparatus or into the color-kitchen.

After the dye solution has been conveyed either into the dyeing apparatus or into the color kitchen, it is necessary to rinse each pipe. This has to be done in order to insure that the following dye solution, differring from the previous one, may be sent through the apparatus without being contaminated.

To this purpose it is necessary to rinse the pipes twice, the first rinsing taking place immediately after all the dye solution has been conveyed from dissolution vat 3 to the dyeing equipment or to the color kitchen, by flushing the pipes with water.

A successive rinsing is obtained by connecting the solution-conveying pipes to the pipe 47 belonging to the water network. To reach this purpose it necessary first of all, to activate the jack 46, which by lifting the collector pipe 136 will disconnect its pipe union 36 from the inlet 45 of the plate 40. Successively it is necessary to activate the jack 44, which, through the square 144, which is attached to the plate 40 through a pin 244 acting at its fulcrum, causes the collector pipe 148, fixed to the square 144, to rotate.

Figure 3:
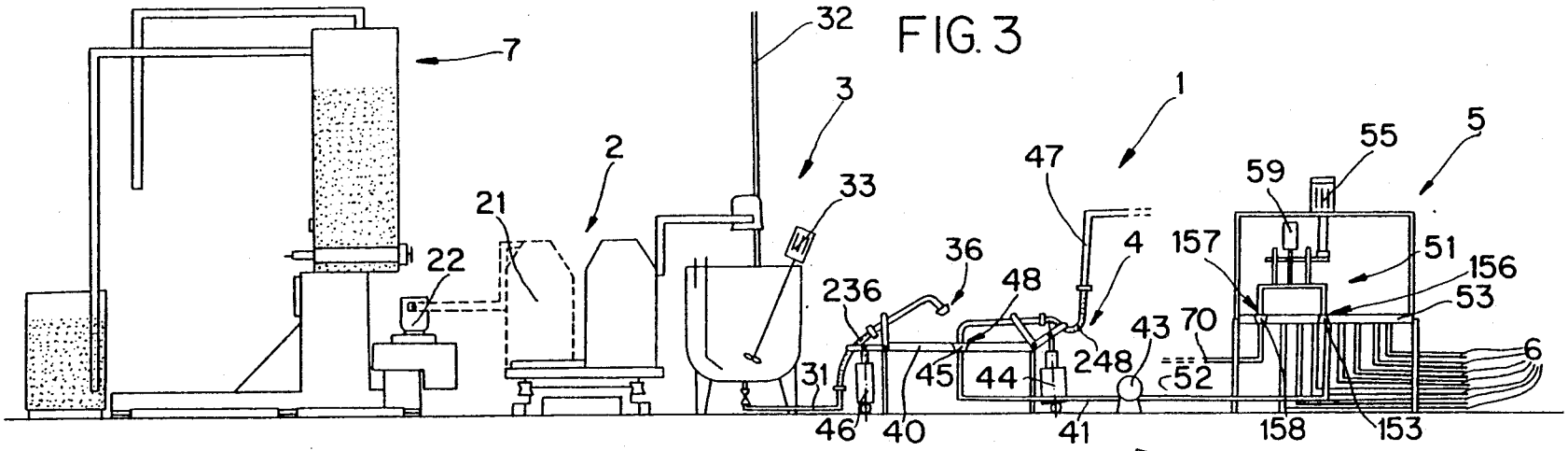
FIG. 3 shows the apparatus of FIG. 1, while the pipes are being rinsed out.

The pipe union 48 at the end of the collector pipe 148 is therefore inserted into the inlet 45 of the plate 40, thereby connecting the pipe 41 with the water-network 47, as can be observed in FIG. 3.

In this case, too, the connection to the water-network 47 is created through a flexible pipe section 248, to allow the rotation of the collector pipe 148.

At the same time the rotary distributor 51 is activated, through the motor 55, in order to connect the central inlet 153 of the distributor plate 53 and therefore its feeding pipe 52, with the outlet 158, placed on the plate 53 and which drains into the sewers, through the pipe 70.

In this case, too, the connection has to be realized by starting the motor 55 and successively by connecting the "U" type collector pipe 54, with the outlets 158 of the distributor plate 53, by activating the jack 59.

After all of these connections have been carried out and after the apparatus has been arranged as represented in FIG. 3, the flush water can flow through the pipe 47 and, through the pump 43 it flows along the pipes 52 and along the type "U" collector pipe 54, thereby flushing them and, thereafter, draining into the sewers, through the pipe 70, all the dye residues of the formula which has just been used.

At this point the apparatus is ready to start the cycle again and to convey a different dye solution into another dyeing apparatus.

It can be understood from this detailed description that the apparatus does not use any three-way valves and, consequently the possible inconvenience due to accidental breakage or to a jamming of any three-way valve during the opening or closing phase or of any pipe conveying of the dye solution is avoided. Therefore the risks arising from the non-conveyance of the dye solution into the apparatus or into the color kitchen or from the introduction of the wrong dyes or from the leakage of the dye solution, due to breaking down of the valves, are eliminated.

In order to avoid also the possibility that a wrong positioning of the rotary distributor 51 and, therefore, of its type "U" collector pipe 54, may cause a wrong connection between the inlet 153 and one of the outlets 158, thereby pouring into one of the pipes 6 and, therefore into one of the dyeing apparatuses, or into the color kitchen, a solution differring from the required one, a metal disk 71 acting as a reference for a proximity switch 72 is placed next each outlet 51, as can be seen in FIG. 8. The proximity switch 72 is solidly connected with collector pipe 54 and, therefore, it rotates together with the rotary ditributor 51.

When the pipe union 157 of the peripheral end 57 of collector pipe 54 is positioned vertically on one of the outlets 158, the proximity switch 72 is arranged on the metal reference disk 71 corresponding to the same outlet 158 and it signals the position to the computer, which checks whether the outlet 158, which has to been connected with the central inlet 153 through the collector pipe 54, is the correct one.

If the outlet is not correct the computer stops the apparatus and signals the error, through a visual or acoustic alarm, to the person supervising the apparatus.

The elimination of the three-way valves permits a more linear flow in the junctions, thereby eliminating the possible presence of undercuts favoring the accumulation of residues of the dye solution, which cannot be eliminated through flushing and which may contaminate the successive formula.

Figure 5:
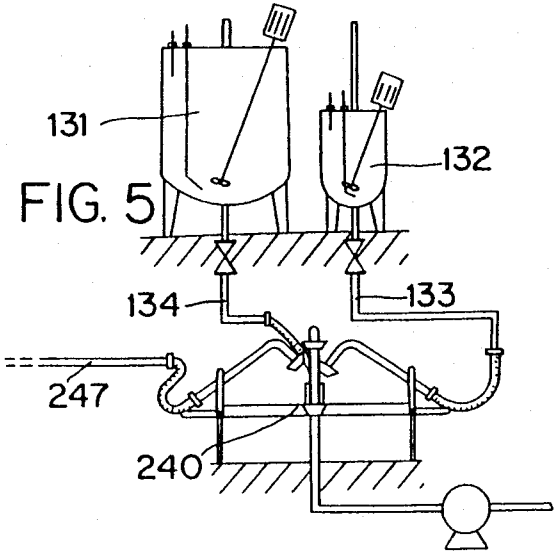
FIG. 5 shows a variation concerning the insertion of two dissolution vats in the apparatus.

The apparatus according to the invention allows a modified embodiment based on the same idea of solution as far as the dissolution vat 3 is concerned. Instead of being a single vat, it can be a double vat, as represented in FIG. 5.

In this case it can observed that a large quantity of formula is dissolved in vat 131, which is bigger, while the smaller size vat is used to dissolve a corrective formula or a smaller quantity of formula.

Therefore three pipes and precisely pipe 247 for the conveyance of the flushing water and pipes 134 and 133 for the conveyance of the dye solutions, which have been dissolved in the vats 131 and 132 respectively lead to the selection plate 240.

The embodiment that has just been described in detail also reaches all the proposed purposes and presents, therefore, all the advantages.

During the execution phase of the invention it is possible to modify some elements so as to improve the performance of the apparatus and to make its manufacture easier. For instance, as has been said, the loading unit could consists of several robots or of several manipulators or of other mechanical means, or the dissolution of the formula can take place in one or more dissolution vats. Moreover, when it is necessary to decrease the overall dimensions of the apparatus, a possible embodiment consists of the vertical positioning of the selection plate, also in the case where the modified embodiment presents more than one dissolution vat.

The equipment can include feelers, level controls, signal devices or other elements, their purpose being that of checking the performance of the equipment or of detecting anomalies in its performance.

It is understood, however, that all modifications do not exceed the scope of the present invention.

We claim:

1. An apparatus for preparing and distributing dye solutions to one of a dyeing equipment or to a color kitchen in dyeing plants, said apparatus comprising:

a unit for loading powder dye into dissolution vats;

a water-network for supplying flushing water to said apparatus;

a collector unit for collecting prepared dye solution flowing out of the dissolution vats and for receiving water from said water-network, said collector unit including a selection plate having a taper-shaped inlet and an outlet, at least two collector pipes, each of said at least two collector pipes having a taper-shaped fitting for selective mating with the taper-shaped inlet of said selection plate, and driving means for selectively connecting the taper-shaped fitting of each of said at least two collector pipes with the taper-shaped inlet of said selection plate, wherein one of said at least two collector pipes supplies dye solution to said selection plate from the dissolution vats and the other of said at least two collector pipes supplies the flushing water to said selection plate from the water-network;

a distributor unit including at least one outlet for distributing the dye solution to the dyeing equipment or to the color kitchen; and means for fluidly connecting the outlet of said selection plate with said distributor unit.

2. The apparatus according to claim 1, wherein the distributor unit includes a plurality of outlets having taper-shaped ends which are circumferentially arranged on a plate, one of sid plurality of outlets being connected to a sewer through a pipe, while remaining ones of said plurality of outlets are connected to a corresponding pipe for conveying the dye solution from the distributor unit to the dyeing equipment or to the color kitchen, an inlet having a taper-shaped end positioned in a center of the plate, a rotary distributor consisting essentially of a "U" shaped collector pipe having a taper-shaped edge at both an inner and outer end thereof, and means for driving the rotary distributor and creating a selective connection by the "U" shaped collector pipe between the inlet of the distributor unit and each of said plurality of outlets of the distributor unit for conveying the dye solution to the dyeing equipment or to the color kitchen through a junction between the taper-shaped ends of the pipe unions of the "U" shaped collector pipe and the plurality of outlets of the plate.

3. The apparatus according to claim 2, wherein the tapered-shaped edge at the inner end of the "U" shaped collector pipe engages with the inlet of the plate of the distributor unit, and the taper-shaped edge at the outer end of the "U" shaped collector pipe engages with any one of said plurality of outlets.

4. The apparatus according to claim 2, wherein the tapered-shaped edge at the inner end of the "U" shaped collector pipe includes a female tapered end which penetrates into the inlet of said distributor unit having a male tapered end, while the taper-shaped edge at the outer end of the "U" shaped collector pipe includes a male tapered end, which penetrates into any one of said plurality of outlets having a female tapered end.

5. The apparatus according to claim 2, wherein next to each of said plurality of outlets of the plate of the distributor unit there is a metal disk acting as a reference for a proximity switch, which is attached to the "U" shaped collector pipe and to the rotary distributor, and has the task of checking whether a selection of a connected one of said plurality of outlets corresponds with a programmed selection whenever the connection of the outer end of said "U" collector pipe is positioned on the vertical line of any one of said plurality of outlets.

6. The apparatus according to claim 2, further including a step motor for rotating said distributor around a vertical axis passing through a center of the inlet, driving means being provided for driving the "U" shaped collector pipe in upward and downward movements thereof.

7. The apparatus according to claim 1, wherein said at least two collector pipes are each connected to a square, each square being attached to said selection plate and having its fulcrum around a pin movable by hydraulic or pneumatic jacks driving the squares to which the at least two collector pipes are attached.

8. The apparatus according to claim 1, wherein the taper-shaped fittings of the collector pipes which convey the solution to the selection plate include a male tapered end and the inlet of the selection plate includes a female tapered end.

* * * * *